US011613896B2

(12) United States Patent
Makwich

(10) Patent No.: US 11,613,896 B2
(45) Date of Patent: Mar. 28, 2023

(54) PRESSURE EQUALIZED RAINSCREEN SYSTEMS AND METHODS

(71) Applicant: GRANDVIEW EA BUILDING SYSTEMS CORP., Vancouver (CA)

(72) Inventor: Gordon Donald Makwich, Vancouver (CA)

( * ) Notice: Subject to any disclaimer, the term of this patent is extended or adjusted under 35 U.S.C. 154(b) by 0 days.

(21) Appl. No.: 17/229,288

(22) Filed: Apr. 13, 2021

(65) Prior Publication Data

US 2022/0325529 A1 Oct. 13, 2022

(51) Int. Cl.

*E04F 13/08* (2006.01)
*E04F 13/12* (2006.01)
*E04F 13/00* (2006.01)

(52) U.S. Cl.

CPC ..... *E04F 13/0869* (2013.01); *E04F 13/007* (2013.01); *E04F 13/0826* (2013.01); *E04F 13/12* (2013.01); *E04F 13/0862* (2013.01)

(58) Field of Classification Search

None

See application file for complete search history.

(56) References Cited

U.S. PATENT DOCUMENTS 2,645,824 A * 7/1953 Titsworth ..... E04B 1/7069 52/302.3
5,946,870 A * 9/1999 Bifano ..... E04F 19/02 52/254
8,769,894 B2 * 7/2014 Power ..... E04B 1/70 52/302.3
9,388,626 B2 * 7/2016 Gilbert ..... E06B 7/28
10,494,818 B2 * 12/2019 Maziarz ..... E06B 7/2303
2007/0119105 A1 * 5/2007 MacDonald ..... E04F 13/0826 52/235
2010/0037549 A1 * 2/2010 Lynch ..... E04F 17/00 52/506.08
2018/0112414 A1 * 4/2018 Maziarz ..... E04F 13/068
2019/0323241 A1 * 10/2019 Margalit ..... E04F 13/072

OTHER PUBLICATIONS

"Rain Penetration Control: Applying Current Knowledge", Developed by: The Canada Mortgage and Housing Corporation, Published by: The American Architectural Manufacturers Association, Ottawa, Ontario, Canada, 2000, pp. 1-48.

* cited by examiner

*Primary Examiner* — Joshua K Ihezie

(57) ABSTRACT

Systems and methods for a pressure equalized rainscreen (PER) and for mounting the same to a building. A PER system includes a panel disposed over an exterior wall that defines a cavity adjacent to the building for pressure equalization. Moisture is drained out of the cavity via a first opening(s), and air flows into and out of the cavity for pressure equalization via a second opening(s). The panel is configured to hinder flowing air via the first opening(s) and hinder draining moisture via the second opening(s). The PER system is mounted using a plurality of mounting strips that demarcate wall portions corresponding to panels for covering those wall portions. Each panel is movably engaged with a mounting strip for support and to allow deformation of the panel once fastened to the exterior wall.

35 Claims, 6 Drawing Sheets

PRESSURE EQUALIZED RAINSCREEN SYSTEMS AND METHODS

TECHNICAL FIELD

The disclosure relates generally to systems and methods for controlling moisture penetration in buildings, and particularly, pressure equalized rainscreens for buildings.

BACKGROUND

Rainscreen systems are used to control moisture penetration into and around buildings, including preventing generation and accumulation of condensed water around buildings and preventing ingress of rainwater.

Rainscreen systems can directly block moisture by used of sealants, impermeable surfaces, and moisture barriers. Rainscreen systems can prevent moisture penetration by controlling driving factors. Example driving factors are kinetic forces, gravity, surface tension, capillary action, and pressure differences that drive water into buildings. The relative significance of factors can vary based on rainscreening approach, application and ambient conditions. For example, in many cases, pressure-driven flow (arising due to pressure differences) may be important for vertical walls, impervious exterior finishes, and for lightweight wall systems.

Solid brick, block or stone masonry, concrete, and solid timber or log construction may be used in traditional construction to form mass wall systems. Such systems work by shedding most of the rain and moisture deposited thereon and absorbing the remainder during a wetting event to prevent penetration into the building. The absorbed moisture is then released under dry conditions. Such mass wall systems may be expensive and unreliable.

In a face-seal approach, water resistant exterior surfaces are sealed together to control air leakage and water penetration and/or an internal drainage plane is used, rather than controlling the factors driving leakage and penetration. The reliability of a face-seal approach may be reduced under temperature cycling, solar radiation, and frequent exposure to moisture, due to degradation of seals.

In a drained cavity approach, free draining material (or an empty space) is formed between an inner wall and an outer wall. One of the two walls is more airtight and large pressure differentials form across this wall. Water may penetrate the outer wall but the free draining material may prevent contact. However, such an approach may not work satisfactorily under large pressure gradients as then moisture is forced across the outer wall and may end up penetrating the inner wall, e.g. through joints and pores, due to accumulation, and due to degradation of building materials.

In a pressure equalized rainscreen (PER) system, two layers of material form inner and outer walls and are separated by a cavity or free draining material. The inner wall is an air barrier and the outer wall is vented to the exterior. The outer wall manages moisture penetration due to raindrop momentum. The cavity or free draining material manages moisture penetration due to capillarity, surface tension and gravity. The inner wall manages moisture penetration due to pressure differences. However, only relatively small amounts of moisture penetrates through to the inner wall, e.g. due to the function of the inner and outer wall, and since (static) pressure is equalized across the outer wall. For example, the inner wall may be a back up wall and may include water resistant sheathing. Flashing is provided for draining. The space between inner and outer walls is divided into compartments so that air that passes through the rainscreen vents is prevented from flowing laterally therein, e.g. towards low pressure regions formed at the building top and corners. Moisture may yet penetrate the outer wall in PER systems, which may lead to degradation of building materials, including leakage, and growth of mould. For example, air carrying moisture may penetrate through drainage vents in an outer wall of a PER system.

PER systems may include panels that at least partially define the pressure equalized compartments. Installing such panels may be expensive and inconvenient. For example, panels may need to be installed sequentially. Additionally, such panels are known to fail.

Improvement is desired.

SUMMARY

Rainscreening and building damage due to moisture penetration costs building owners billions of dollars every year in repairs and remediation. In some cases, rainscreening once performed needs to be repeated due to degradation and poor performance. Excessive waste is produced in installation and repair, leading to poor environmental outcomes. Financially struggling homeowners, including owners of condominiums, are under pressure and often live under a cloud of uncertainty vis-a-vis the reliability of (or lack of) rainscreens on their homes. The situation is dire in parts of the world known to receive heavy precipitation, particularly where local populations are already suffering from ballooning housing and building costs, e.g. in the Pacific Northwest of the US and the west coast of Canada. Pressure equalized rainscreen (PER) systems may form effective rainscreens. However, improvement is desired, particularly in reliability and costs associated with installation, manufacturing, and repair.

Controlling moisture and air flow across panels of PER systems is important for achieving well performing rainscreening. In some aspects, it is found that separating moisture and air flows improves pressure equalization and mitigates moisture penetration. In some aspects, the disclosure describes panels for PER systems that have specialized openings for draining moisture that hinder flowing air and specialized openings for flowing air for pressure equalization that hinder moisture. In some aspects, the disclosure describes panels that are configured to hinder flowing air and/or moisture into the respective openings for moisture and flowing air.

Winds may change rapidly during a wetting event. A PER system may have to respond rapidly to such changes to prevent ingress of moisture, e.g. during a transient phase of the PER system prior to substantially complete pressure equalization. It is found that ingress of moisture may be mitigated by achieving faster pressure equalization and hindering moisture penetration during the transient phase. In some aspects, the disclosure describes a slot defining a flow restriction for drawing air into and out of a pressure equalization cavity for pressure equalization via openings for flowing air. For example, the slot may rely on a venturi effect to facilitate pressure equalization and may be recessed to mitigate moisture penetration. In some aspects, the disclosure describes a receptacle formed in the pressure equalization cavity for draining moisture via openings for moisture and for collecting moisture adjacent to such openings to hinder flowing air and uptake of moisture into the cavity. In some aspects, the disclosure describes a receptacle that shelters the slot. In some aspects, the disclosure describes a slot that generates a layer of moving air for mitigating moisture drainage through openings for flowing air. For example, in some cases, near instantaneous pressure equalization may result.

Costs of PER systems may be reduced by reducing cost of installation and allowing easier/faster repair. Costs of installation may be reduced by introducing greater flexibility in how the panels are installed. For example, in some cases, construction workers would have significant "downtime" waiting for other work to be completed on portions of an exterior wall.

In prior art systems, sequential installation of panels on a wall substrate or girt is required, e.g. due to interlocking panels, making installation expensive due to a lack of flexibility in selecting which panels to install first. In prior art system, making repairs is also more expensive or difficult, since panels may not be individually removed and repaired.

In some aspects, the disclosure describes a free-floating PER system achieved by using a mounting assembly that facilitates installation of panels on mounting strips. The mounting strips define mounting locations where the panels are installed and demarcate portions of an exterior wall to be covered. These portions corresponding to pressure equalized compartments extending through to the exterior wall. The mounting strips obviate a need for positioning of panel relative to each and interlocking fastening of the panels. In some cases, only a relatively small number of mounting strips may be needed, e.g. 20 mounting strips distributed as a square grid may accommodate 80 panels or more. Panels may be selectively installation and removed. For example, this may allow workers to continue installing panels if some portions of the exterior wall are unavailable, and also allow easy repair and replacement. In some cases, the mounting strips can also allow movable or removable engagement to allow easy positioning.

A PER system of a building and panels may undergo significant stresses, e.g. due to thermal expansion and contraction, wind loading, seismic loading, loading of floor slabs, and other live or static forces applied to the PER system and/or the building. In some aspects, the disclosure describes a mounting system wherein the panels are at least partially movably engaged with mounting strips to support the panel while mitigating building up of stresses in panels. For example, deformation of the panel due to thermal expansion and contraction may be accommodated by movement of the panel while remaining engaged with a mounting strip for support. In some aspects, the disclosure describes a guide which the panel slidably engages with. For example, the guide may be a resilient clip allowing easy and quick installation.

In one aspect, there is disclosed a pressure equalized rainscreen (PER) system for a building, comprising: a panel disposed over an exterior wall of the building to hinder moisture penetration, the panel defining a cavity adjacent to the building for pressure equalization, a first one or more openings for draining moisture out of the cavity, and a second one or more openings for flowing air for pressure equalization of the cavity, the panel configured to hinder flowing air via the first one or more openings and draining moisture via the second one or more openings.

In another aspect, the disclosure describes a pressure equalized rainscreen (PER) panel configured to be disposed over an exterior wall of a building to form a cavity adjacent to the building for hindering moisture penetration, the pressure equalized rainscreen (PER) panel defining a first one or more openings configured to drain moisture out of the cavity and hinder flowing air, and a second one or more openings configured to allow flowing air for pressure equalization and hinder draining of moisture.

In a further aspect, the disclosure describes a method of forming a pressure equalized rainscreen (PER) system for a building: forming a cavity adjacent to the building for pressure equalization; draining moisture from the cavity using a first one or more openings of the cavity; hindering flowing air via the first one or more openings; flowing air via a second one or more openings of the cavity for pressure equalization of the cavity; and hindering draining moisture via the second one or more openings.

In one aspect, the disclosure describes a pressure equalized rainscreen (PER) system for an exterior wall, comprising: a plurality of mounting strips configured to fasten to the exterior wall to define a plurality of mounting locations; and a plurality of panels for covering the exterior wall, each panel anchored to the exterior wall by fastening to at least one of the plurality of mounting locations and movably engaged with at least one of the plurality of mounting strips to support the panel and allow deflection of the panel relative to the at least one of the plurality of mounting locations.

In another aspect, the disclosure describes a mounting assembly for non-sequential installation of a plurality of panels of a pressure equalized rainscreen (PER) system on an exterior wall, the mounting assembly comprising: a plurality of mounting strips configured to fasten to the exterior wall to define a plurality of wall portions corresponding to the plurality of panels, the plurality of wall portions and the plurality of mounting strips forming a tessellation of the exterior wall covering the exterior wall, each panel of the plurality of panels configured to cover a wall portion of the plurality of wall portions by fastening to at least one mounting strip of the plurality of mounting strips at least partially demarcating the wall portion and movably engaging with at least one mounting strip of the plurality of mounting strips at least partially demarcating the wall portion to provide support and allow deformation of the panel.

In yet another aspect, the disclosure describes a method of mounting a panel of a pressure equalized rainscreen (PER) system on an exterior wall, comprising: anchoring the panel to the exterior wall by fastening the panel to a first mounting strip fastened to the exterior wall; and movably engaging the panel with a second mounting strip to support the panel to cover a wall portion of the exterior wall and allow deflection of the panel relative to the first mounting strip.

Embodiments can include combinations of the above features.

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

The following disclosure relates to pressure equalized rainscreen (PER) systems and ways of installing the same.

Aspects of various embodiments are described in relation to the figures.

Figures 1A, 1B, 1C:
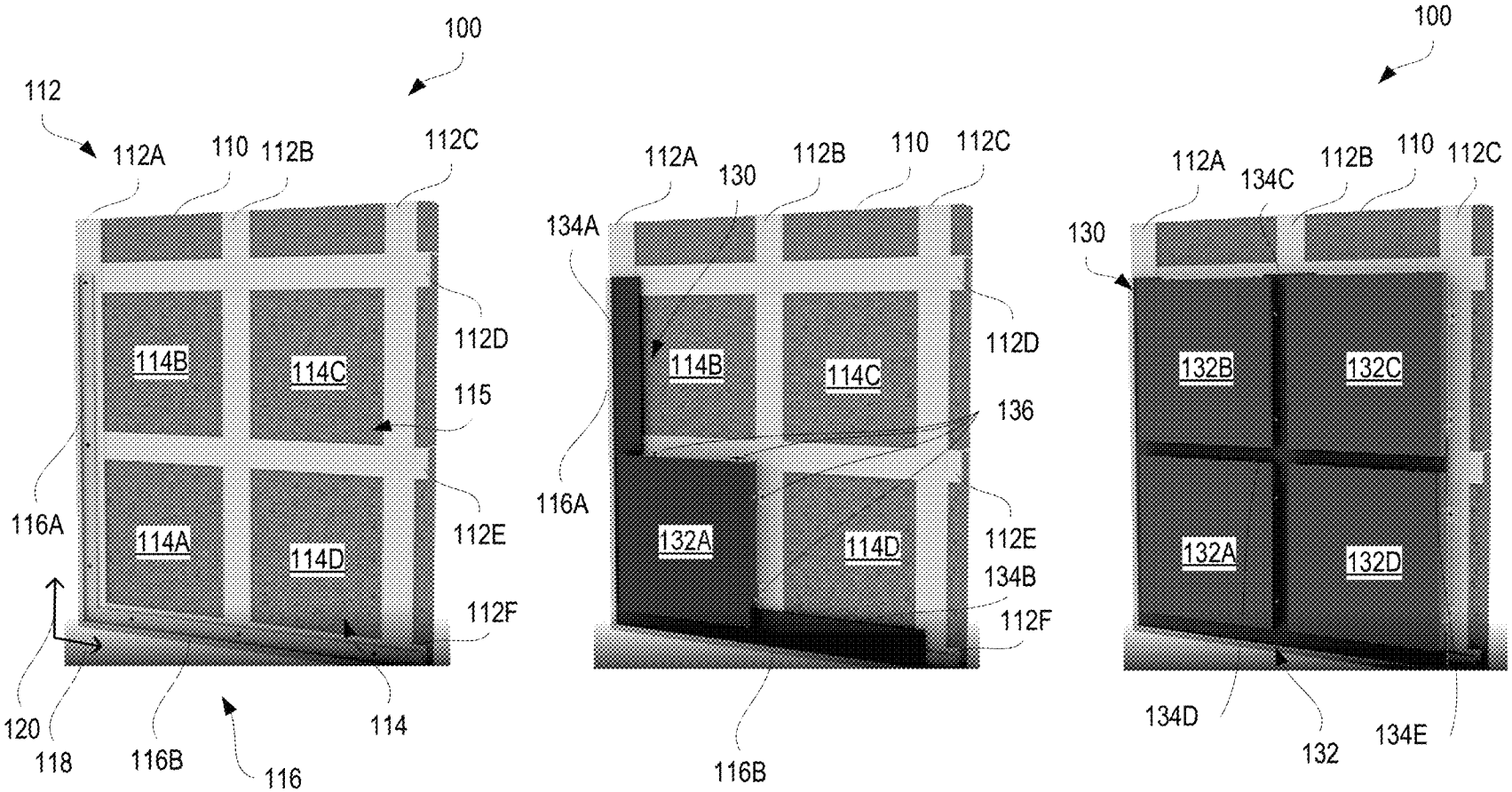
FIG. 1A is a perspective view of a mounting assembly for a pressure equalized rainscreen (PER) system prior to installation of the PER system.
FIG. 1B is a perspective view of the mounting assembly during installation of the PER system.
FIG. 1C is a perspective view of the mounting assembly after partial installation of the PER system.

FIGS. 1A-1C are perspectives views of a mounting assembly 100 for a pressure equalized rainscreen (PER) system 130 showing steps involved in forming the PER system 130.

FIG. 1A is a perspective view of the mounting assembly 100 prior to installation of the PER system 130.

FIG. 1B is a perspective view of the mounting assembly 100 during installation of the PER system 130.

FIG. 1C is a perspective view of the mounting assembly 100 after partial installation of the PER system 130.

The mounting assembly 100 may include mounting strips 112A, 112B, 112C, 112D, 112E, 112F (referred to collectively as a plurality of mounting strips 112).

The plurality of mounting strips 112 may be configured to fasten to an exterior wall 110 of a building, e.g. a residential or office building. In various embodiments, the plurality of mounting strips 112 may be fastened using threadable fasteners, and/or rivets. As referred to herein, exterior wall 110 may refer to part of an exterior wall 110 to be covered for rainscreening, e.g. a concrete wall.

The plurality of mounting strips 112 may be made of structural materials and may be fastened to retain a load without detaching or failing. In some embodiments, the mounting strips 112 may include galvanized steel.

The plurality of mounting strips 112 may be fastened on the exterior wall 110 in such a manner to define wall portions 114A, 114B, 114C, 114D (referred to collectively as a plurality of wall portions 114) of the exterior wall 110. The plurality of mounting strips 112 may partially or fully demarcate the respective wall portions 114A, 114B, 114C, 114D by defining outer boundaries of each of the wall portions 114A, 114B, 114C, 114D.

The plurality of mounting strips 112 may be fastened to the wall substrate and may at least partially define pressure equalized compartments extending to the exterior wall 110. The base of each pressure equalized compartment may be defined by one or more mounting strips. The plurality of mounting strips 112 may allowing coupling of panels to the exterior wall 110.

The plurality of wall portions 114 and the plurality of mounting strips 112 may form a tessellation 115 of the exterior wall 110 to cover the exterior wall 110. The portions of the exterior wall 110 in-between the plurality of mounting strips 112 may define the plurality of wall portions 114.

The plurality of mounting strips 112 have a finite non-negligible width, and may themselves cover a portion of the exterior wall 110. As referred to herein, it is understood that the plurality of wall portions 114 and the tessellation 115 take into account any such portions of the exterior wall 110 covered by the plurality of mounting strips 112. For example, in some embodiments, each of the plurality of wall portions 114 may be defined so that none, some or all of the portions of the exterior wall 110 covered by the plurality of mounting strips 112 may be included in the plurality of wall portions 114, with any remaining portions of exterior wall 110 covered by the plurality of mounting strips 112 completing the tessellation 115.

In various embodiments, each wall portion of the plurality of wall portions 114 may be rectangular. In some embodiments, as shown in FIG. 1A, the plurality of mounting strips 112 may be distributed over the exterior wall 110 to form a grid defining the plurality of wall portions 114.

For example, mounting strips 112A, 112B, 112C may be spaced apart from each other and be oriented in a vertical direction, while mounting strips 112D, 112E, 112F may be spaced apart from each and be oriented in a horizontal direction to intersect the mounting strips 112A, 112B, 112C. The rectangular portions of the exterior wall 110 formed between neighbouring, spaced apart, horizontal mounting strips 112D, 112E or 112E, 112F and neighbouring, space apart, vertical mounting strips 112A, 112B or 112B, 112C may form the plurality of wall portions 114.

The plurality of mounting strips 112 may be fastened to the exterior wall 110 to define a plurality of mounting locations 136. The plurality of mounting locations 136 may form part of the plurality of mounting strips 112. In some embodiments, the plurality of mounting locations 136 may form part of the exterior wall 110.

The PER system 130 may include panels 132A, 132B, 132C, 132D (referred to collectively as a plurality of panels 132) for covering the exterior wall 110. For example, in some embodiments, each panel 132A, 132B, 132C, 132D may be square with a substantially 7-inch side. In various embodiments, the plurality of wall portions 114 may correspond to the plurality of panels 132.

The plurality of panels 132 may cover the exterior wall 110 by covering the corresponding the plurality of wall portions 114. Since the plurality of wall portions 114 tessellate (or form a tessellation of) the exterior wall 110, exposed parts of the exterior wall 110 may be thereby covered by the panels 132.

For example, each panel 132A, 132B, 132C, 132D of the plurality of panels 132 may be configured to cover a (corresponding) wall portion 114A, 114B, 114C, 114D of the plurality of wall portions 114 by fastening to one or more of the plurality of mounting strips 112 at least partially demarcating the respective wall portion 114A, 114B, 114C, 114D.

The plurality of mounting locations 136 may be used to mount the plurality of panels 132 on the exterior wall 110. For example, mounting locations 136 may be locations where fasteners such as rivets are driven in.

In some embodiments, one or more panels 132A, 132B, 132C, 132D of the plurality of panels 132 may be anchored to the exterior wall 110 by fastening to at least one of the plurality of mounting locations 136. For example, the panel 132A may be anchored to the exterior wall 110 by fastening to the mounting strips 112B, 112E.

As referred to herein, the panel 132A may be representative, e.g. representative of any one of panel 132B, 132C, 132D.

In various embodiments, the panel 132A so anchored to the exterior wall 110 may have a portion held fixed to a respective mounting location. In various embodiments, the panel 132A so anchored to the exterior wall 110 may still permit deflection or movement, e.g. due to rotation or material deformation due to thermal expansion, seismic loading, wind loading, static loading, or other factors.

In some embodiments, the plurality of mounting locations 136 may leave at least one end or edge portion of the panel 132A substantially free for at least partial movement relative to the mounting locations 136. For example, the panel 132A may be fastened to the exterior wall 110 using a mounting location at a vertical end of the panel 132A and a panel at a horizontal end of the panel 132A. In some embodiments, two or more mounting locations may be used to fasten an end of the panel 132A, e.g. a vertical end or a horizontal end.

In some embodiments, each of the panels 132A, 132B, 132C, 132D may be movably engaged with at least one of the plurality of mounting strips 112 to support the respective panel 132A, 132B, 132C, 132D, e.g. by acting as a stop and/or at least partially supporting the weight of the respective panel. In various embodiments, such support may retain a respective one of the plurality of panels 132 substantially in-place to cover a corresponding wall portion of the exterior wall 110.

In various embodiments, movable engagement may prevent material stresses from building up. Stresses may be managed by allowing (at least partially free) deformation of the panel 132A under loading and movement of one or more of the plurality of mounting locations 136 to which a respective panel 132A, 132B, 132C, 132D is fastened. Loading may include live loading, static loading and/or thermal expansion.

For example, movable engagement may allow deflection of each of the panels 132A, 132B, 132C, 132D relative to at least one of the plurality of mounting locations 136, and/or the one or more of the plurality of mounting strips 112, to which the respective panel 132A, 132B, 132C, 132D is attached.

In some embodiments, movable engagement may facilitate installation and positioning by supporting the panel 132A. For example, the one or more of the plurality of mounting strips 112 may be configured to removably engage with the panel 132A to position the panel 132A for fastening.

In some embodiments, the plurality of mounting strips includes a plurality of guides 116 for movably engaging with one or more of the plurality of panels 132. The guides 116 may provide support and limit motion along a predetermined direction(s).

The plurality of guides 116 may slidably engage with one or more of the plurality of panels 132 to retain and position the one or more of the plurality of panels 132 for fastening.

In some embodiments, a guide of the plurality of guides 116 may include an extrusion with a cross-section defining a groove for receiving, and retaining therein, a complementary (extruded) feature of a panel of the plurality of panels 132.

For example, the panel 132A may be movably engaged with the mounting strip 112A and the mounting strip 112F. The panel 132A may be slidably engaged with a guide 116A of the mounting strip 112A and a guide 116B of the mounting strip 112F at least partially lateral to the guide 116A to allow deflection of the panel 132A relative to the first mounting strip. For example, the guide 116A may be a vertical guide, oriented in a vertical direction 120, and the guide 116B may be a horizontal guide, oriented in a horizontal direction 118.

In various embodiments, splines 134A, 134B, 134C, 134D, 134E may extend along the plurality of mounting strips 112 to cover the plurality of mounting strips 112.

In various embodiments, the facades of the plurality of panels 132 and the splines 134A, 134B, 134C, 134D, 134E may be made of or include similar or dissimilar materials, including water impervious materials, lightweight materials, and/or non-structural rigid materials. In some embodiments, Aluminium Composite Material (ACM) may be used.

The plurality of mounting strips 112 and the plurality of guides may facilitate installation of a PER system on the exterior wall 110 by facilitating non-sequential installation of the plurality of panels 132.

Sequential installation may refer to an installation of the plurality of panels 132 wherein each panel is dependent on an adjacent panel, such as for support and/or positioning. For example, in a sequential installation, a panel may only be installed after at least one adjacent panel thereto has been installed. Non-sequential installation may allow the plurality of panels 132 to be installed substantially independently of one another.

In some embodiments, the plurality of mounting strips 112 may be installed on the exterior wall 110, such as by fastening. The plurality of panels 132 may be mounted in any order. For example, the panel 132A may be installed first, followed by the panel 132C. In some embodiments, the panel 132A is first slidably engaged with the plurality of guides 116 to support the panel 132A against the exterior wall 110 while allowing positioning of the panel 132A. After the panel 132A is in proper position, it is fastened to one or more of the plurality of mounting strips 112 to hold it in a substantially fixed position. When the panel 132A undergoes thermal expansion, it remains fixed to the exterior wall 110 and expands along the one or more of the plurality of guides 116. Similarly, when the building undergoes mechanical loading such as live loading (seismic or wind loads) or static loading (loading of floor slabs or other structural members of the building), the panel 132A may slidably engage with plurality of guides 116 to prevent build up of stress in the panel 132A.

Figure 2:
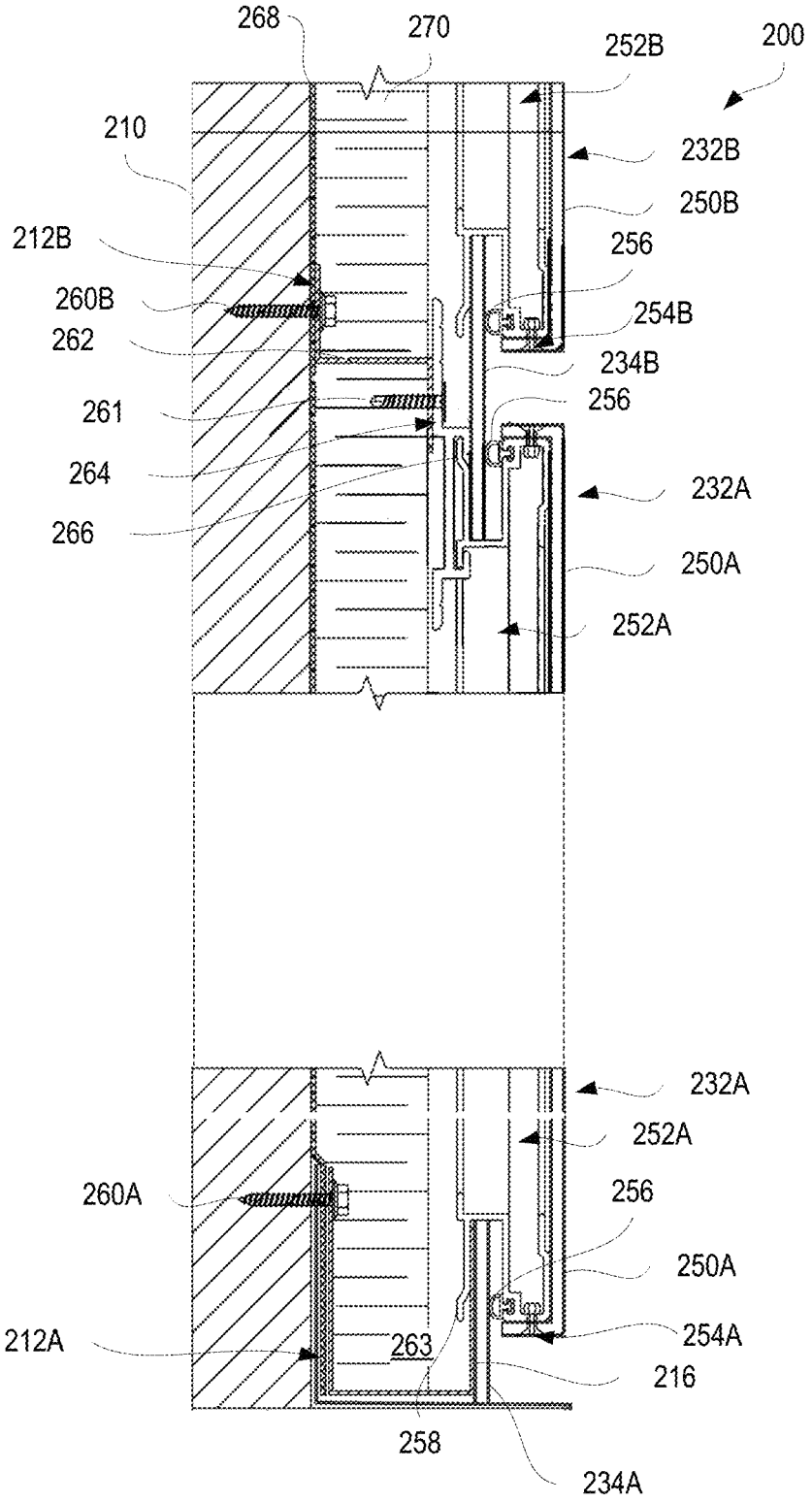
FIG. 2 is a broken sectional view of a mounted PER system along a vertical cut through mounting strips for mounting the panels on an exterior wall.

FIG. 2 is a broken sectional view of a mounted PER system 200 along a vertical cut through mounting strips 212A, 212B for mounting the panels 232A, 232B on an exterior wall 210.

Each of the panels 232A, 232B has respective facades 250A, 250B for preventing ingress of moisture into corresponding cavities 252A, 252B defined by the panels 232A, 232B. The cavities 252A, 252B may be pressure equalized with the ambient (outside or exterior) air to prevent drawing in rain thereinto. Pressure equalization may be achieved by allowing flow of air into and out of the cavities 252A, 252B while preventing moisture from being drawn thereinto. In various embodiments, slots (not shown, see FIGS. 3A-3C) for flowing air may be provided for pressure equalization.

The panels 232A, 232B may include respective weep holes or openings 254A, 254B for draining moisture out of the cavities 252A, 252B. For example, such moisture may be generated due to condensation. The panels 232A, 232B includes a plurality of gaskets 256 for sealing the panels against splines 234A, 234B disposed between the panels 232A, 232B. The splines 234A, 234B may fill in gaps between adjacent panels. In some embodiments, the spline 234A may be part of the panel 232A and the spline 234B may be part of the panel 232B. The splines 234A, 234B may be retained in position by (e.g. frictional) engagement with extensions or lips, and/or gaskets.

The mounting strip 212A may be securely fastened to the exterior wall 210 using a fastener 260A. The fastener 260A may be a threadable fastener.

The mounting strip 212A may include a guide 216 defining a groove 263 with a substantially U-shaped or J-shaped cross-section. In some embodiments, the guide 216 may be a resilient member configured to act as a clip.

The panel 232A may include a lower extension or lower lip 258 for movably or slidably engaging with the guide 216. The lower lip 258 may straddle the guide 216 and protrude into the groove 263. In various embodiments, the lower lip 258 may be engaged with the guide 216 without fasteners. For example, the lower lip 258 may be a resilient member and/or may be frictionally engaged with the guide 216. In various embodiments, other guides may be engaged with other lips of the panel 232A.

The mounting strip 212B of the panel 232A may be securely fastened to the exterior wall 210 using a fastener 260B by engaging with the exterior wall 210 and a girt 262 of the mounting strip 212B. The girt 262 may be made of or include structural materials, e.g. steel.

In various embodiments, the girt 262 may have a substantially Z-shaped cross-section defining two arms extending outwardly at opposed ends. The two arms may facilitate a double fastener arrangement. A first arm may be used for fastening to the exterior wall 210 via the fastener 260B and a second arm may be used to engage with an adapter 264 via a fastener 261.

In various embodiments, the fasteners 260B, 261 may be threadable fasteners.

The adapter 264 may be engaged with an upper extension or upper lip 266 of the panel 232A to connect the girt 262 to the panel 232A for support and fastening to the exterior wall 210.

In various embodiments, insulating materials 270 may be disposed between the exterior wall and the panels 232A, 232B. In various embodiments, the girt 262 and guide 216 may at least partially pass through the insulating materials 270. Increased insulation may reduce temperature drop adjacent to the exterior wall 210 and thereby discourage condensation and movement of moisture from an interior out of the exterior wall 210.

In some embodiments, a substantially impermeable air-water barrier 268 may disposed between the insulating materials 270 and the exterior wall 210 to prevent moisture seepage and maintain dryness of the insulating materials 270.

Extrusion may be used to manufacture various components, e.g. girt 262, guide 216, lower lip 258, and upper lip 266 may be manufactured by extrusion.

Figure 3A:
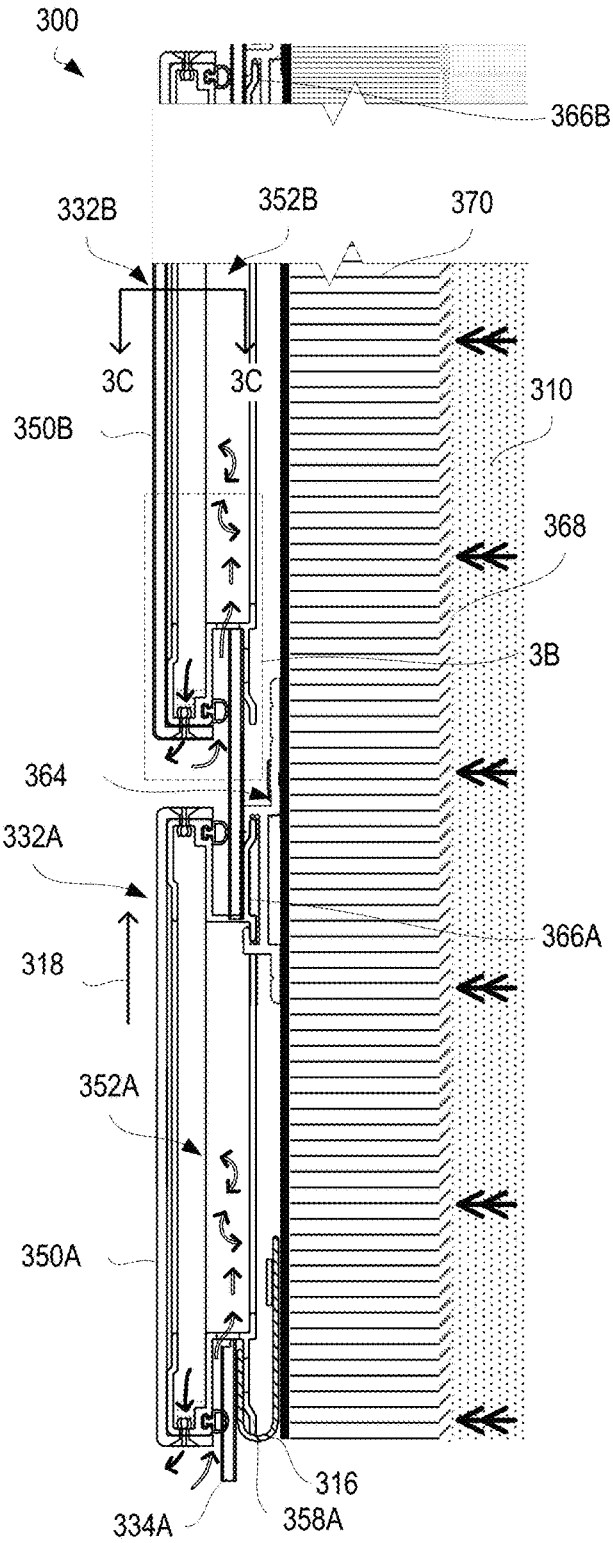
FIG. 3A is a sectional view of a PER system along a vertical cut, shown mounted on an exterior wall of a building.

FIG. 3A is a sectional view of a PER system 300 along a vertical cut, shown mounted on an exterior wall 310 of a building.

Figure 3B:
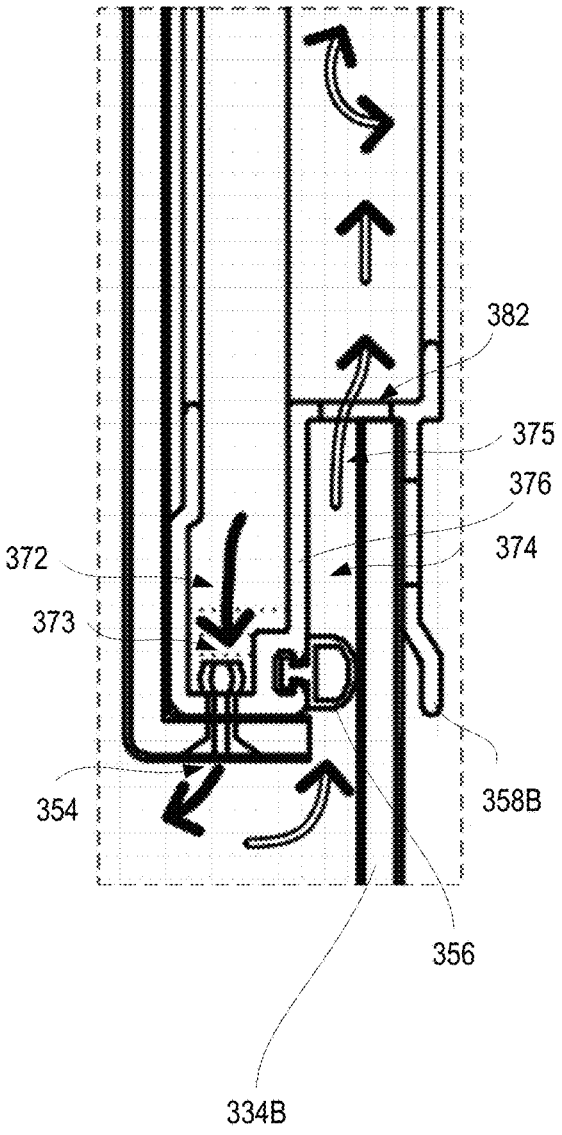
FIG. 3B is an enlarged view of region 3B in FIG. 3A.

FIG. 3B is an enlarged view of region 3B in FIG. 3A.

Figure 3C:
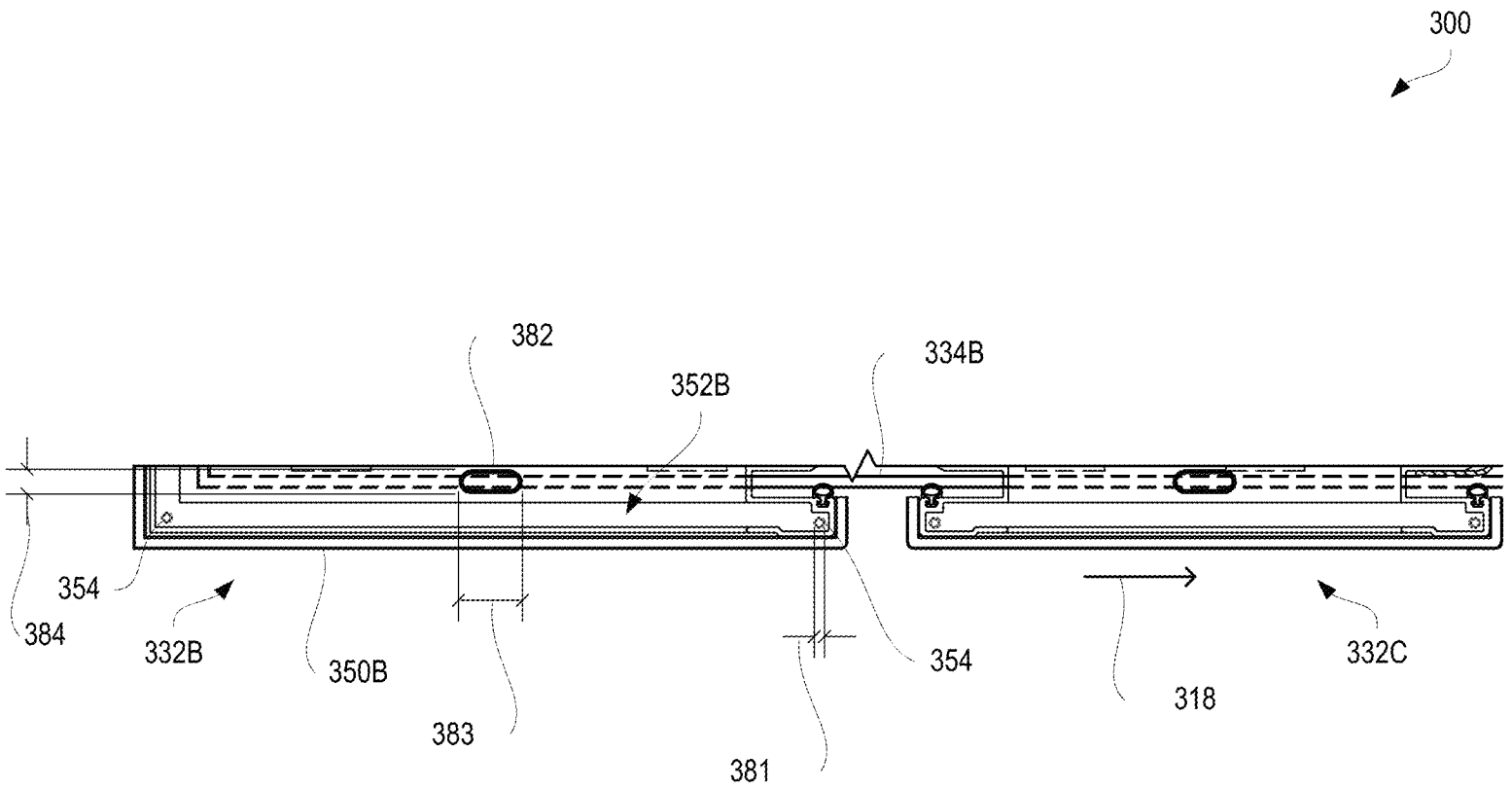
FIG. 3C is a partial sectional view of the PER system along a horizontal cut indicated by line 3C-3C in FIG. 3A.

FIG. 3C is a partial sectional view of the PER system 300 along a horizontal cut indicated by line 3C-3C in FIG. 3A.

In FIGS. 3A-3C, example moisture flow is indicated with thick black arrows; example moisture flow from the building (such as steam or condensate) is shown with thick black double-headed arrows, and example air flow is shown with hollow-bodied arrows.

The PER system 300 includes panels 332A, 332B, 332C disposed adjacent each other and over the exterior wall 310 to hinder moisture penetration, Panels 332A, 332B, shown in FIG. 3A, are spaced apart in a vertical direction 318 and panels 332B, 332C, shown in FIG. 3C, are spaced apart in a horizontal direction 320. For example, as shown in FIG. 3C, panel 332B may be a corner panel and may include corner bends configured to engage with the exterior wall 310 to complete closing of a space defined adjacent to the exterior wall 310. For clarity, in what follows, panels 332A, 332B will be discussed. It is understood that parts of this discussion may apply to other panels, including panel 332C.

Panels 332A, 332B may define respective cavities 352A, 352B adjacent to the building for pressure equalization. As referred to herein, the cavities 352A, 352B may be empty or may contain or be defined by free draining material. The cavities 352A, 352B may be formed between the exterior wall 310 and the corresponding facades 350A, 350B of the panels 332A, 332B. As shown in FIG. 3A, the panel 332B includes vertical ends that are substantially sealed, except for openings discussed later, to form obstructions or stops to vertical flow. Similarly, as shown in FIG. 3C, the panels 332B includes horizontal ends that are substantially sealed to form obstructions or stops to horizontal flow.

The cavities 352A, 352B may form or serve as pressure equalization compartments adjacent to the building for hindering moisture penetration. A pressure equalization compartment formed over a portion of the exterior wall 310 may act and be configured to hinder pressure driven moisture flow (moisture laden flow) towards and along (and/or parallel to) the exterior wall 310. The horizontal and vertical ends hinder lateral flow and serve to compartmentalize the PER system (into a plurality of compartments) covering the exterior wall 310. In some cases, faster pressure equalization may be achieved. For example, if and when an exterior or ambient flow condition changes around a particular portion of the exterior wall 310, only the pressure equalization compartment(s) corresponding to that portion, and possibly nearby compartment(s), may need to be pressure equalized to achieve pressure equalization over an entirety of the exterior wall 310. Similarly, a wind facing side of the building may not suffer from lateral flow parallel to the exterior wall 310 induced by the stagnation point flow formed over the wind facing side.

The PER system may include splines 334A, 334B for completing sealing or closing of the cavities 352A, 352B. The splines 334A, 334B may directly or indirectly engaged with gaskets to provide a sealing function.

The spline 334B may be disposed between the panel 332A and the panel 332B. In some embodiments, gaskets protruding outwardly from the panels 332A, 332B may (frictionally) engage with the spline 334B to form a tight fit and fill a space or gap between the panel 332A and the panel 332B to hinder moisture penetration. For example, a lower lip 358B of the panel 332B may be frictionally engaged with a first side of the spline 334B and a gasket 356 may be frictionally engaged with a second side of the spline 334B opposed the first side.

The panel 332A may be movably engaged with the exterior wall via a guide 316. The guide 316 may be an extrusion having a substantially J-shaped cross-section defining a groove for retainably receiving a lower lip 358A of the panel 332A. The lower lip 358A may slidably engage with the guide 316 along an extrusion direction (into and out of paper in FIG. 3A). A first side of the guide 316 may be slidably engaged with the lower lip 358A. A second side of the guide 316 opposed the first side may be frictionally engaged with a first side of the spline 334A. A second side of the spline 334A may be frictionally engaged with a gasket protruding from the panel 332A. The spline 334A and the guide 316 may be disposed (sandwiched), or squeezed, in between opposed portions of the panel 332A: the gasket and the lower lip 358A. The guide 316 may be fastened to the exterior wall 310 to retain the panel 332A in position.

An adapter 364 may facilitate mounting of the panel 332A to the exterior wall 310. The adapter 364 may be complementary to an upper lip 366A of the panel 332A. In some embodiments, the adapter 364 may form a female end configured to engage with a male end defined by the upper lip 366A. In some embodiments, the upper lip 366A includes two vertically spaced apart extensions configured to fit into the adapter 364. An upper lip 366B of the panel 332B may be similarly coupled to an adapter. The adapter 364 may be fastened to the exterior wall 310 to retain the panel 332A in position.

The adapter 364 and the guide 316 may be fastened to the exterior wall 310 through insulating material 370. The insulating material 370 may be configured to prevent heat loss from the building and to mitigate moisture, in the form of condensation, from forming in spaces between the facades 350A, 350B and the exterior wall 310. An air-water barrier 368 may be disposed between the insulating material 370 and the exterior wall 310.

The panel 332B may define a first one or more openings 354 (or opening(s) 354) for draining moisture out of the cavity 352B. In some cases, these may also be known as weep holes. In various embodiments, the panel 332B and the opening(s) 354 may be configured to take advantage of gravitational flow of moisture. For example, the opening(s) 354 may be disposed at a lower vertical end of the panel 332B to receive moisture flowing downwards due to gravity. In various embodiments, features and obstruction may guide the moisture towards the opening(s) 354 for efficient draining and to avoid accumulation of moisture. In some embodiments, surfaces of the panel 332B may be sloping downwards (have a vertical gradient) in the horizontal direction 320 to guide moisture for drainage.

The panel 332A may be configured to drain moisture through the opening(s) 354 while hindering flowing air therethrough. Flowing air may include air flowing into the cavity 352B or out of the cavity 352B via the opening(s) 354. In some embodiments, the opening(s) 354 may be configured to prevent or hinder uptake of fluids, including water. For example, flowing air (or gas exchange) may occur during pressure equalization. Pressure equalization via the opening(s) 354 may occur slowly or not at all.

For example, in various embodiments, the opening(s) 354 may include one or more circular apertures for draining moisture therefrom. For example, in some embodiments, each of the one or more circular apertures may have a diameter less than 0.25 inches (see diameter 381). The relatively smaller size of such apertures may hinder air flow while allowing gravity-driven moisture flow collecting adjacent to the apertures to flow through. In various embodiments, uptake of moisture into the cavity 352B via the opening(s) 254 may also be hindered.

The panel 332B may define a receptacle 372 connected to the cavity 352B to collect moisture therefrom (see dotted lines in the receptacle 372) and facilitate draining of moisture from the cavity 352B. The opening(s) 354 may open into the receptacle 372. In some embodiments, the opening(s) 354 may be formed in a lower portion 373 of the receptacle 372 to take advantage of gravity-driven flow flowing thereto.

Moisture collected in the receptacle 372 may drain out of the cavity 352B via the opening(s) 354. For example, the receptacle 372 may be vertically elongated to facilitate vertical accumulation of moisture to drive moisture through the opening(s) 354 at least partially due to a relatively higher hydrostatic pressure in the receptacle 372 adjacent to the opening(s) 354. Such accumulation of moisture in the receptacle 372 adjacent to the opening(s) 354 may also hinder flow of air into the cavity 352B via the opening(s) 354, e.g. due to an adverse pressure gradient, surface tension at the liquid-gas interface, and/or resistance to aeration of accumulated liquid in the receptacle 372.

In some embodiments, sizing of the receptacle 372 (volume, cross-sectional area, and/or vertical length) and the opening(s) 354 (diameter 381) may be based on a threshold tolerable moisture accumulation in the cavity 352B, e.g. during a precipitation event or during an excessive cold event (encouraging condensation), and based on known moisture ingress tolerance into the cavity 352B (such as due to leakage, degradation of gaskets and other sealing components, and transient effects during pressure equalization).

The panel 332B may define a second one or more openings 382 (or opening(s) 382), separate from openings 354, to allow flowing air between the cavity 352B and the outdoor ambient atmosphere (external to the building). The panel 332B and the opening(s) 382 may be adapted for flowing air into and out of the cavity 352B for pressure equalization of the cavity 352B. The panel 332B and the opening(s) 382 may be configured to hinder draining moisture via the opening(s) 382.

In some embodiments, the opening(s) 382 may include an aperture for flowing air. In various embodiments, an aperture of the opening(s) 354 may be smaller than the aperture of the opening(s) 382 to hinder flowing air through the aperture of the opening(s) 354 relative to the aperture of the opening(s) 382. For example, an aperture of the opening(s) 354 may define a smaller flow area relative to an aperture of the opening(s) 382, and/or smaller individual dimensions (vertical or horizontal, or). Smaller areas and/or flow areas may cause increased flow resistance and/or lead to stronger surface tension effects, which may hinder flowing air and lead to preferential air flow through the opening(s) 382.

In various embodiments, the opening(s) 382 may include an oblong aperture for flowing air. The oblong aperture may be elongated at least 0.75 inches (length 383) and have a width 384 of at least 0.25 inches. In some embodiments, the oblong aperture may define a (flow-through) area at least three times larger than an area of any one aperture of the opening(s) 354. Such dimensions may be particularly favourable to allow flow of fluids through the opening(s) 382 for rapid pressure equalization. Such rapid pressure equalization may prevent or mitigate ingress of slower moving moisture (particles) through the opening(s) 382.

In various embodiments, the opening(s) 382 may open at least partially vertically downward to hinder flow of moisture into the cavity 352B, particularly moisture from gravity-driven flow and natural precipitation (such as rain). For example, the opening(s) 382 may be facing vertically down or may be angled down and towards the exterior wall 310 to reduce ingress of moisture.

In various embodiments, the opening(s) 382 may be vertically separated from the opening(s) 354 to cause preferential flow of moisture through the opening(s) 354 (or, alternatively, to hinder flow of moisture through the opening(s) 382). For example, the opening(s) 382 may be vertically higher than the opening(s) 354 to cause moisture in the cavity 352B to preferentially flow through the opening(s) 354 rather than the opening(s) 382.

In some cases, as air flows through the opening(s) 382, it creates a layer of moving air adjacent thereto. In some embodiments, a layer of moving air discourages other impinging fluids (moisture) and/or encourages drying or wicking away of moisture.

In some embodiments, the opening(s) 382 may open proximal to the building (or exterior wall 310) relative to the opening(s) 354 to form a layer of moving air adjacent thereto and to the exterior wall 310. The layer of air may shelter the exterior wall 310 from moisture by forming an intervening layer. In some embodiments, moisture may be displaced away from the building and into opening(s) 354 at least partially due to the layer of moving air.

In some embodiments, the panel 332B may define a slot 374 adjacent to the opening(s) 382, and the cavity 352B. The opening(s) 382 may open into the slot 374 and may be in flow communication with outside ambient atmosphere via the slot 374.

The slot 374 may facilitate pressure equalization. The slot 374 may be configured to form a flow restriction for air flowing through the opening(s) 382 and may also form one or more corners. Such a flow restriction may cause a venturi effect to rapidly draw air into the cavity 352B via the opening(s) 382. For example, faster or more rapid pressure equalization may result. In some cases, the slot 374 may cause generate of flow recirculation and low-pressure zones which may facilitate drawing air into the opening(s) 383 in air. For example, in some cases, one or more corners may force fluid to at least partially reverse direction prior to entering the opening(s) 382. For example, in some cases, local flow stagnation may occur. In various embodiments, flow of moisture may be discouraged by the slot 374.

In some embodiments, the slot 374 or at least partially defined by an outer wall 376 of the receptacle 372. Advantageously, the outer wall 376 may be a common member simultaneously (at least partially) defining the receptacle 372 and the slot 374 via opposed sides of the outer wall 376. For example, in some cases, the outer wall 376 may be an extrusion.

In various embodiments, the slot 374 may be at least partially recessed into the panel to hinder flow of moisture into the cavity 352B via the opening(s) 382. The slot 374 may form a partial moisture barrier by sheltering the opening(s) 382. In some embodiments, the slot 374 may at least partially be recessed into the panel 332B relative to the receptacle 372.

In some embodiments, the opening(s) 382 may open into an upper portion 375 of the slot 374. In various embodiments, the lower portion 373 of the receptacle 372 may be vertically lower than the upper portion 375 of the slot 374. The relative positioning may hinder moisture flow into and out of the opening(s) 382 and hinder flowing air into and out of the opening(s) 354.

Figure 4:
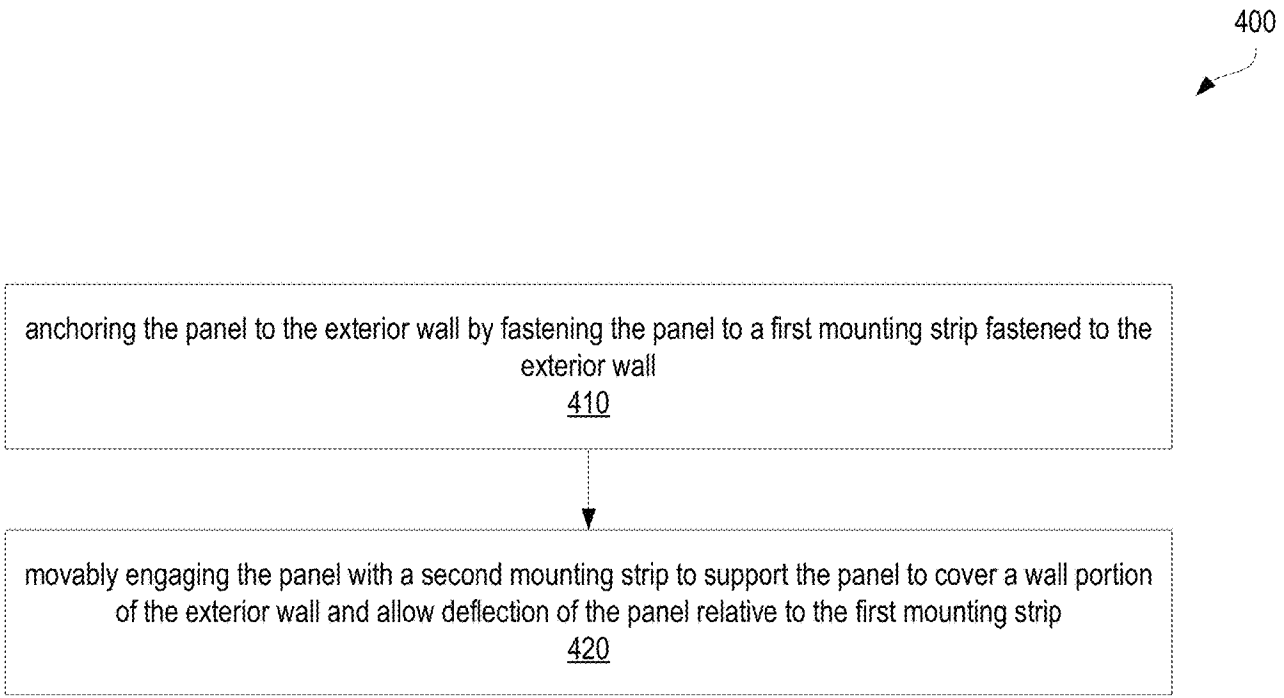
FIG. 4 is a flow chart of an exemplary method of mounting a panel of a pressure equalized rainscreen (PER) system on an exterior wall.

FIG. 4 is a flow chart of an exemplary method 400 of mounting a panel of a pressure equalized rainscreen (PER) system on an exterior wall.

Step 410 includes anchoring the panel to the exterior wall by fastening the panel to a first mounting strip fastened to the exterior wall.

Step 420 includes movably engaging the panel with a second mounting strip to support the panel to cover a wall portion of the exterior wall and allow deflection of the panel relative to the first mounting strip.

In some embodiments of the method 400, movably engaging the panel with the second mounting strip may include slidably engaging the panel with a guide at least partially lateral to the first mounting strip.

Figure 5:
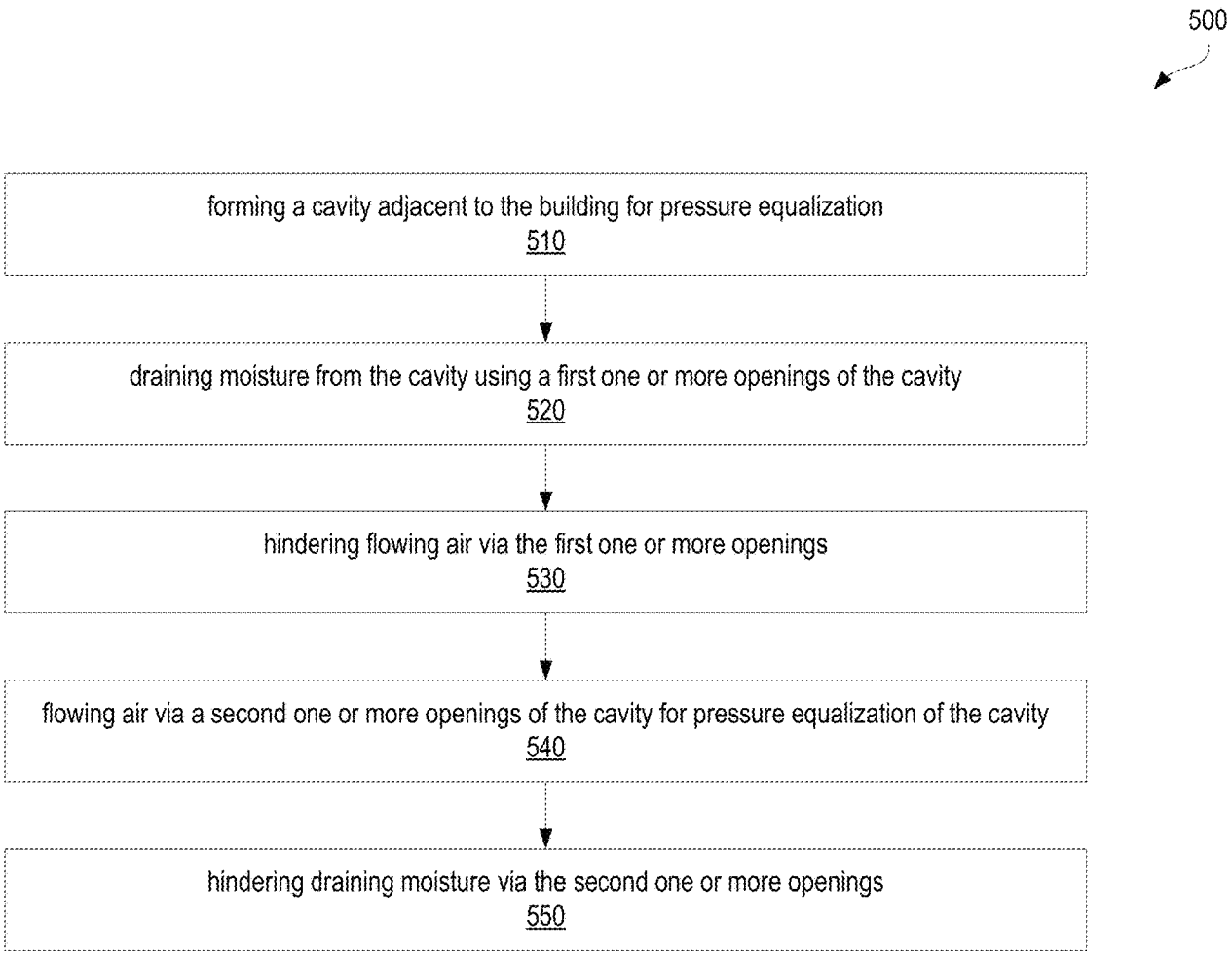
FIG. 5 is a flow chart of an exemplary method of forming a pressure equalized rainscreen (PER) system for a building.

FIG. 5 is a flow chart of an exemplary method 500 of forming a pressure equalized rainscreen (PER) system for a building.

Step 510 includes forming a cavity adjacent to the building for pressure equalization.

Step 520 includes draining moisture from the cavity using a first one or more openings of the cavity.

Step 530 includes hindering flowing air via the first one or more openings.

Step 540 includes flowing air via a second one or more openings of the cavity for pressure equalization of the cavity.

Step 550 includes hindering draining moisture via the second one or more openings.

As can be understood, the examples described above and illustrated are intended to be exemplary only.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, additional panels may be disposed on top of or under the pressure equalized rainscreen (PER) system. Yet further modifications could be implemented by a person of ordinary skill in the art in view of the present disclosure, which modifications would be within the scope of the present technology.

What is claimed is:

1. A pressure equalized rainscreen (PER) system for a building, comprising:

a panel disposed over an exterior wall of the building to hinder moisture penetration, the panel defining a cavity adjacent to the building for pressure equalization, a first one or more openings for draining moisture out of the cavity, and a second one or more openings for flowing air for pressure equalization of the cavity, the panel configured to hinder flowing air via the first one or more openings and to hinder draining moisture via the second one or more openings, wherein the second one or more openings open into a slot defined by the panel, the slot configured to form a flow restriction for air flowing through the second one or more openings to cause a venturi effect for pressure equalization, the second one or more openings receive flowing air via the slot, and the slot is recessed at least partially behind the panel to open at least partially vertically downward to hinder flow of moisture into the cavity via the second one or more openings.

2. The pressure equalized rainscreen (PER) system of claim 1, wherein:

the first one or more openings includes a first aperture for draining moisture; and the second one or more openings includes a second aperture for flowing air, wherein the first aperture is smaller than the second aperture to hinder flowing air through the first aperture relative to the second aperture.

3. The pressure equalized rainscreen (PER) system of claim 1, wherein the panel defines a receptacle connected to the cavity to collect moisture from the cavity, and the first one or more openings open into the receptacle to drain moisture collected in the receptacle and hinder flow of air into the cavity via the first one or more openings.

4. A pressure equalized rainscreen (PER) system for a building, comprising:

a panel disposed over an exterior wall of the building to hinder moisture penetration, the panel defining a cavity adjacent to the building for pressure equalization, a first one or more openings for draining moisture out of the cavity, and a second one or more openings for flowing air for pressure equalization of the cavity, the panel configured to hinder flowing air via the first one or more openings and to hinder draining moisture via the second one or more openings, wherein the panel defines a receptacle connected to the cavity to collect moisture from the cavity, the first one or more openings open into the receptacle to drain moisture collected in the receptacle and hinder flow of air into the cavity via the first one or more openings, and the second one or more openings open into a slot at least partially defined by an outer wall of the receptacle, the slot configured to form a flow restriction for air flowing through the second one or more openings for pressure equalization, the slot being recessed into the panel relative to the receptacle to hinder flow of moisture into the cavity via the second one or more openings.

5. The pressure equalized rainscreen (PER) system of claim 4, wherein the first one or more openings are formed in a lower portion of the receptacle, and the second one or more openings open into an upper portion of the slot, the lower portion of the receptacle being vertically lower than the upper portion of the slot.

6. The pressure equalized rainscreen (PER) system of claim 1, wherein the second one or more openings open at least partially vertically downward to hinder flow of moisture into the cavity via the second one or more openings.

7. A pressure equalized rainscreen (PER) system for a building, comprising:

a panel disposed over an exterior wall of the building to hinder moisture penetration, the panel defining a cavity adjacent to the building for pressure equalization, a first one or more openings for draining moisture out of the cavity, and a second one or more openings for flowing air for pressure equalization of the cavity, the panel configured to hinder flowing air via the first one or more openings and to hinder draining moisture via the second one or more openings, wherein the first one or more openings includes a circular aperture of diameter less than 0.25 inches and the second one or more openings includes an oblong aperture with an area at least three times larger than an area of the circular aperture.

8. A pressure equalized rainscreen (PER) system for a building, comprising:

a panel disposed over an exterior wall of the building to hinder moisture penetration, the panel defining a cavity adjacent to the building for pressure equalization, a first one or more openings for draining moisture out of the cavity, and a second one or more openings for flowing air for pressure equalization of the cavity, the panel configured to hinder flowing air via the first one or more openings and to hinder draining moisture via the second one or more openings, wherein the second one or more openings open proximal to the building relative to the first one or more openings to form a layer of moving air that displaces moisture away from the building and into the first one or more openings, wherein the second one or more openings open into a slot defined by the panel, the slot being configured to form a flow restriction for air flowing through the second one or more openings to cause a venturi effect for pressure equalization, the panel defines a receptacle connected to the cavity to collect moisture from the cavity, and the first one or more openings open into the receptacle to drain moisture collected in the receptacle and hinder flow of air into the cavity via the first one or more openings.

9. The pressure equalized rainscreen (PER) system of claim 1, wherein the first one or more openings are vertically separated from the second one or more openings.

10. The pressure equalized rainscreen (PER) system of claim 1, wherein the panel defines a pressure equalization compartment formed over a portion of the exterior wall to hinder pressure driven moisture flow towards and along the exterior wall.

11. A pressure equalized rainscreen (PER) panel configured to be disposed over an exterior wall of a building to form a cavity adjacent to the building for hindering moisture penetration, the pressure equalized rainscreen (PER) panel defining a first one or more openings configured to drain moisture out of the cavity and hinder flowing air, and a second one or more openings configured to allow flowing air for pressure equalization and to hinder draining of moisture via the second one or more openings, wherein the first one or more openings includes a circular aperture of diameter less than 0.25 inches and the second one or more openings includes an oblong aperture with an area at least three times larger than an area of the circular aperture; and further defining a receptacle connected to the cavity to collect moisture from the cavity, wherein the first one or more openings open into the receptacle to drain moisture collected in the receptacle and hinder flow of air into the cavity via the first one or more openings, the second one or more openings open into a slot at least partially defined by an outer wall of the receptacle, the slot being configured to form a flow restriction for air flowing through the second one or more openings for pressure equalization, the slot being recessed relative to the receptacle to hinder flow of moisture into the cavity via the second one or more openings, the first one or more openings are formed in a lower portion of the receptacle, and the second one or more openings open into an upper portion of the slot, the lower portion of the receptacle being vertically lower than the upper portion of the slot.

12. The pressure equalized rainscreen (PER) panel of claim 11, wherein the second one or more openings open into a slot configured to form a flow restriction for air flowing through the second one or more openings to cause a venturi effect for pressure equalization.

13. The pressure equalized rainscreen (PER) system of claim 3, wherein the slot is at least partially defined by an outer wall of the receptacle and is recessed into the panel relative to the receptacle to hinder flow of moisture into the cavity via the second one or more openings.

14. The pressure equalized rainscreen (PER) system of claim 13, wherein the first one or more openings are formed in a lower portion of the receptacle, and the second one or more openings open into an upper portion of the slot, the lower portion of the receptacle being vertically lower than the upper portion of the slot.

15. The pressure equalized rainscreen (PER) system of claim 1, wherein the first one or more openings includes a circular aperture of diameter less than 0.25 inches and the second one or more openings includes an oblong aperture with an area at least three times larger than an area of the circular aperture.

16. The pressure equalized rainscreen (PER) system of claim 1, wherein the second one or more openings open proximal to the building relative to the first one or more openings to form a layer of moving air that displaces moisture away from the building and into the first one or more openings.

17. The pressure equalized rainscreen (PER) system of claim 4, wherein:

the first one or more openings includes a first aperture for draining moisture; and the second one or more openings includes a second aperture for flowing air, wherein the first aperture is smaller than the second aperture to hinder flowing air through the first aperture relative to the second aperture.

18. The pressure equalized rainscreen (PER) system of claim 4, wherein the second one or more openings open at least partially vertically downward to hinder flow of moisture into the cavity via the second one or more openings.

19. The pressure equalized rainscreen (PER) system of claim 4, wherein the first one or more openings includes a circular aperture of diameter less than 0.25 inches and the second one or more openings includes an oblong aperture with an area at least three times larger than an area of the circular aperture.

20. The pressure equalized rainscreen (PER) system of claim 4, wherein the second one or more openings open proximal to the building relative to the first one or more openings to form a layer of moving air that displaces moisture away from the building and into the first one or more openings.

21. The pressure equalized rainscreen (PER) system of claim 4, wherein the first one or more openings are vertically separated from the second one or more openings.

22. The pressure equalized rainscreen (PER) system of claim 4, wherein the panel defines a pressure equalization compartment formed over a portion of the exterior wall to hinder pressure driven moisture flow towards and along the exterior wall.

23. The pressure equalized rainscreen (PER) system of claim 7, wherein the second one or more openings open into a slot defined by the panel, the slot configured to form a flow restriction for air flowing through the second one or more openings to cause a venturi effect for pressure equalization.

24. The pressure equalized rainscreen (PER) system of claim 7, wherein the panel defines a receptacle connected to the cavity to collect moisture from the cavity, and the first one or more openings open into the receptacle to drain moisture collected in the receptacle and hinder flow of air into the cavity via the first one or more openings.

25. The pressure equalized rainscreen (PER) system of claim 24, wherein the second one or more openings open into a slot at least partially defined by an outer wall of the receptacle, the slot configured to form a flow restriction for air flowing through the second one or more openings for pressure equalization, the slot being recessed into the panel relative to the receptacle to hinder flow of moisture into the cavity via the second one or more openings, and wherein the first one or more openings are formed in a lower portion of the receptacle, and the second one or more openings open into an upper portion of the slot, the lower portion of the receptacle being vertically lower than the upper portion of the slot.

26. The pressure equalized rainscreen (PER) system of claim 7, wherein the second one or more openings open at least partially vertically downward to hinder flow of moisture into the cavity via the second one or more openings.

27. The pressure equalized rainscreen (PER) system of claim 7, wherein the second one or more openings open proximal to the building relative to the first one or more openings to form a layer of moving air that displaces moisture away from the building and into the first one or more openings.

28. The pressure equalized rainscreen (PER) system of claim 7, wherein the first one or more openings are vertically separated from the second one or more openings.

29. The pressure equalized rainscreen (PER) system of claim 7, wherein the panel defines a pressure equalization compartment formed over a portion of the exterior wall to hinder pressure driven moisture flow towards and along the exterior wall.

30. The pressure equalized rainscreen (PER) system of claim 8, wherein:

the first one or more openings includes a first aperture for draining moisture; and the second one or more openings includes a second aperture for flowing air, wherein the first aperture is smaller than the second aperture to hinder flowing air through the first aperture relative to the second aperture.

31. The pressure equalized rainscreen (PER) system of claim 8, wherein the second one or more openings open into a slot at least partially defined by an outer wall of the receptacle, the slot configured to form a flow restriction for air flowing through the second one or more openings for pressure equalization, the slot being recessed into the panel relative to the receptacle to hinder flow of moisture into the cavity via the second one or more openings, and wherein the first one or more openings are formed in a lower portion of the receptacle, and the second one or more openings open into an upper portion of the slot, the lower portion of the receptacle being vertically lower than the upper portion of the slot.

32. The pressure equalized rainscreen (PER) system of claim 8, wherein the second one or more openings open at least partially vertically downward to hinder flow of moisture into the cavity via the second one or more openings.

33. The pressure equalized rainscreen (PER) system of claim 8, wherein the first one or more openings includes a circular aperture of diameter less than 0.25 inches and the second one or more openings includes an oblong aperture with an area at least three times larger than an area of the circular aperture.

34. The pressure equalized rainscreen (PER) system of claim 8, wherein the first one or more openings are vertically separated from the second one or more openings.

35. The pressure equalized rainscreen (PER) system of claim 8, wherein the panel defines a pressure equalization compartment formed over a portion of the exterior wall to hinder pressure driven moisture flow towards and along the exterior wall.

* * * * *